United States Patent [19]

Crowe

[11] 4,156,460

[45] May 29, 1979

[54] RETRIEVABLE DOUBLE GRIP WELL PACKER

[75] Inventor: Talmadge L. Crowe, Houston, Tex.

[73] Assignee: Baker International Corporation, Orange, Calif.

[21] Appl. No.: 848,343

[22] Filed: Nov. 3, 1977

[51] Int. Cl.[2] ..... E21B 23/00

[52] U.S. Cl. ..... 166/120; 166/123; 166/134

[58] Field of Search ..... 166/120, 123, 134

[56] References Cited

U.S. PATENT DOCUMENTS

| | | | |
|---|---|---|---|
| 3,236,309 | 2/1966 | Conrad | 166/134 X |
| 3,374,837 | 3/1968 | Page et al. | 166/120 |
| 3,410,348 | 11/1968 | Page | 166/134 |
| 3,410,348 | 11/1968 | Page | 166/120 |
| 3,422,901 | 1/1969 | Conrad | 166/134 |
| 3,456,723 | 7/1969 | Current et al. | 166/134 X |
| 3,678,998 | 7/1972 | Cockrell et al. | 166/123 |
| 4,044,826 | 8/1977 | Crowe | 166/120 |

*Primary Examiner*—Ernest R. Purser
*Attorney, Agent, or Firm*—Subkow and Kriegel

[57] ABSTRACT

A retrievable double grip well packer having an elongated tubular body, longitudinally spaced, upwardly holding and downwardly holding expander and slip mechanisms and an intermediate, elastomeric deformable packing which are sequentially expanded into anchoring and sealing engagement with the well casing upon relative longitudinal movement between the body and the upwardly holding and downwardly holding slip and cone mechanisms. The body is locked in position holding the packer set and anchored. The downwardly holding slip and cone mechanism is connected to the body by a releasable connection and the elastomeric packing is supported by a telescopic sleeve which enables the slip and cone mechanism to be easily released from the casing. The body and the upwardly holding slip and cone mechanism are constructed to enable the packer to be run on pipe and mechanically actuated by shifting the body relative to casing engaging friction means which effects expansion of the slip and cone mechanisms and the packing. The body and the upper slip mechanism are also structured to be actuated by fluid pressure from within the pipe acting on a pressure setting mechanism for setting the packer. In addition, the upwardly holding slip and cone mechanism and the body are constructed to receive an electric wire line setting tool for setting the packer.

55 Claims, 19 Drawing Figures

RETRIEVABLE DOUBLE GRIP WELL PACKER

Figure 1:
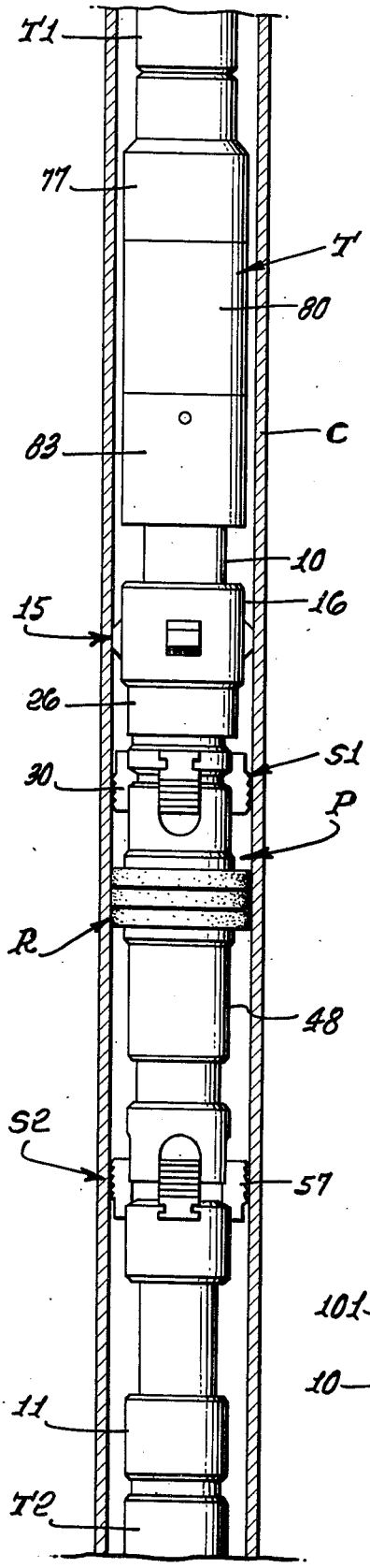

The present invention relates to well bore devices adapted to be anchored in a well bore, and more particularly to devices adapted to be set in anchored relation to the well casing and to be subsequently retrieved.

The well bore device of the invention is a double grip or double holding device of the type having upwardly holding and downwardly holding well casing engaging slip mechanism carried by the tool body and, in the illustrated packer, at opposite ends of the elastomeric deformable packing which is deformed into sealing engagement with the well casing when the packer is set in the well bore casing. Such packers may be subjected to substantial mechanical forces and hydraulic pressures which render retrieval of the packer very difficult, and also the resiliently deformed packing tends to maintain the oppositely holding slip and cone mechanism in tight gripping engagement with the casing. While in some instances the slip and cone mechanisms may be forced to release by pulling or pushing on a pipe string connected to the packer, the packer may be irretrievably anchored against the well casing, under some circumstances, within the capacity of the pipe string to apply forces to the packer assembly tending to release it from engagement with the casing. Heretofore efforts have been made to overcome such problems by structures including the use of collapsible cone and slip mechanisms. However, well bore packers of the double holding type in which the resilient packing element tends to maintain the slips locked against the casing have been primarily utilized in packers which are not intended to be retrieved.

An object of the present invention is to provide such a well bore packer of the double holding type, including a deformable elastomeric packing between oppositely holding slips which can be easily released to enable retrieval of the packer assembly from the well casing.

Another object of the invention is to provide a double holding packer which can be easily retrieved and which can be run into the well bore and set on drill pipe or tubing, by manipulation of the pipe string to set the slips and packing against the holding force of casing engaging drag blocks; which can be run into the well bore on drill pipe or tubing and then hydraulically set by the application of fluid pressure to the running pipe string; or which can be run into the well bore on an electric wire line setting tool and set in the casing by the application of opposite forces by the setting tool.

In accomplishing the foregoing objectives, the packer assembly includes support means for the elastomeric packing element or elements which include telescopic sleeves held in an extended position during the setting of the packer, but releasable to telescopically contract in response to the application of an upward pull on the body of the packer after release of the body from its connection with the anchoring mechanism, such release being accomplished by right hand rotation of a retrieving pipe.

In addition, the body of the packer, adjacent its upper end, and the upper, upwardly holding slip mechanism are structured to be interconnected with a drag block assembly and a J-lock connector device, enabling the packer assembly to be run into the well bore on a length of pipe and then set and anchored in the well casing by manipulation of the pipe string. In another form, the upper end of the packer body and the upwardly holding slip and drag block mechanism are interconnected with a cylinder head connected to the pipe string and having an actuator piston in an annular cylinder exposed to the pressure of fluid in the running in pipe, so that a suitable pipe plugging tool can be utilized to enable the pressurization of the piston chamber and the setting of the packer within the well casing. In another form, the upper end of the packer body and the upwardly holding slip and cone mechanism are connected to an electric wire line setting tool adapted to provide opposite forces to the body and the anchoring and packing mechanisms to set the packer in the well casing. In each form the packer is retrievable in response to right hand rotation of a retrieving pipe string which disconnects the lower slip and cone mechanism from the packer body and enables upward movement of the packer body through the packed off packing and the upwardly and downwardly holding slips to effect release of the support between the packing and the downwardly holding slips, thereby relieving the upwardly and downwardly holding slips of the forceful engagement with respective cones, under the influence of the packing.

This invention possesses many other advantages, and has other objects which may be made more clearly apparent from a consideration of several forms in which it may be embodied. Such forms are shown in the drawings accompanying and forming part of the present specification. These forms will now be described in detail for the purpose of illustrating the general principles of the invention; but it is to be understood that such detailed description is not to be taken in a limiting sense.

Figure 2A:
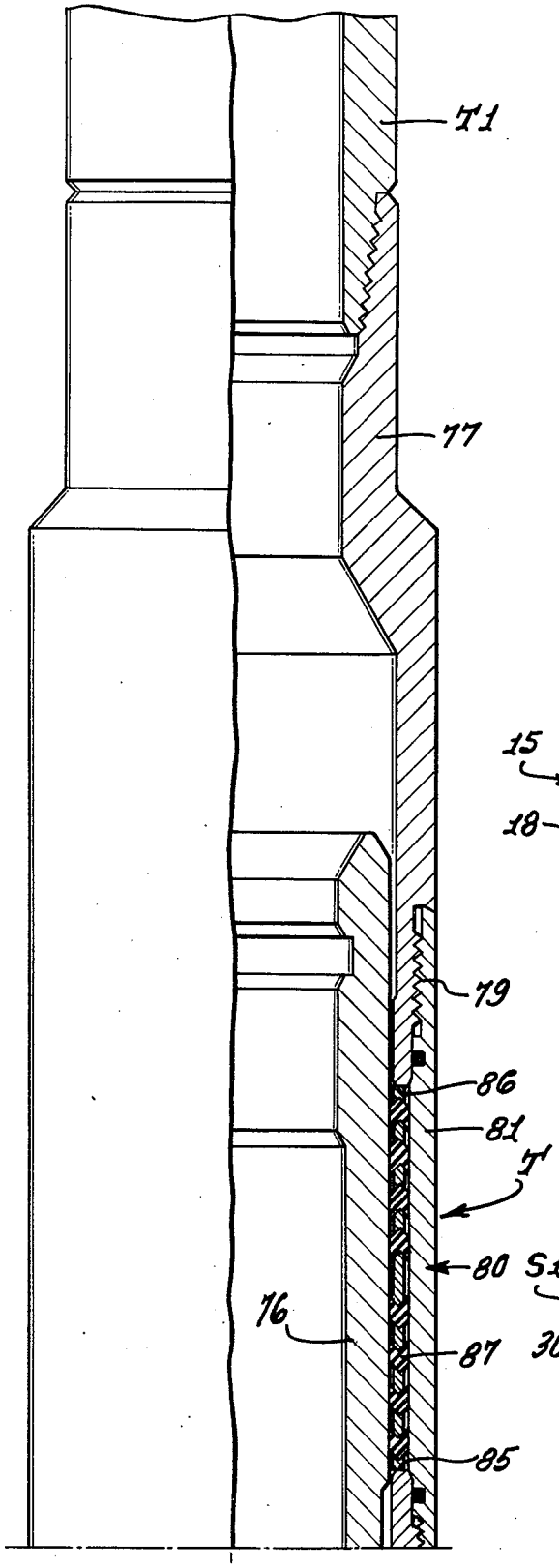
Figure 2B:
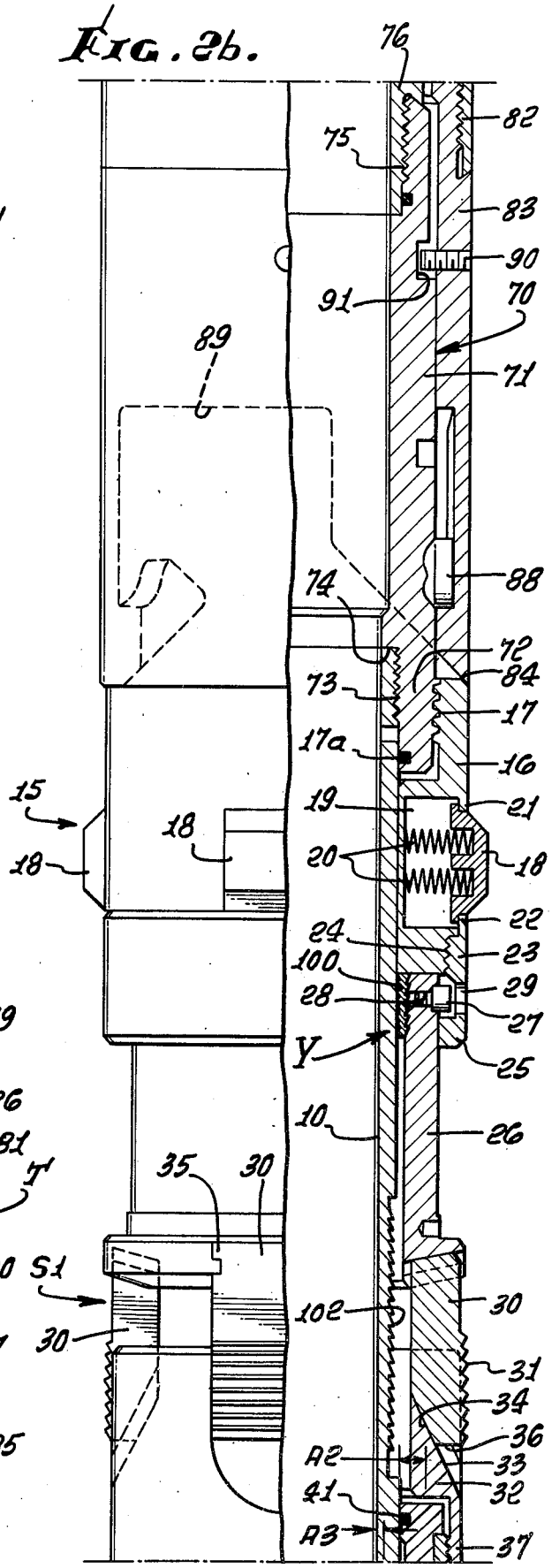
Figure 2C:
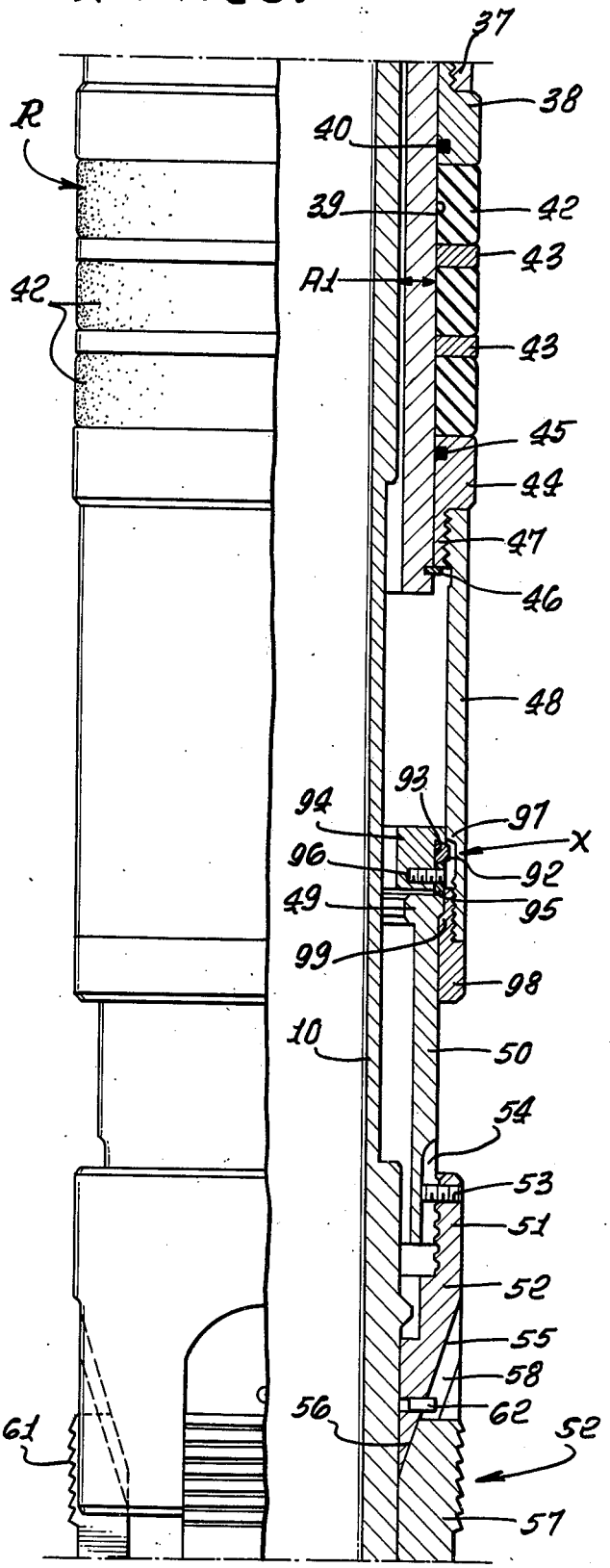
Figure 2D:
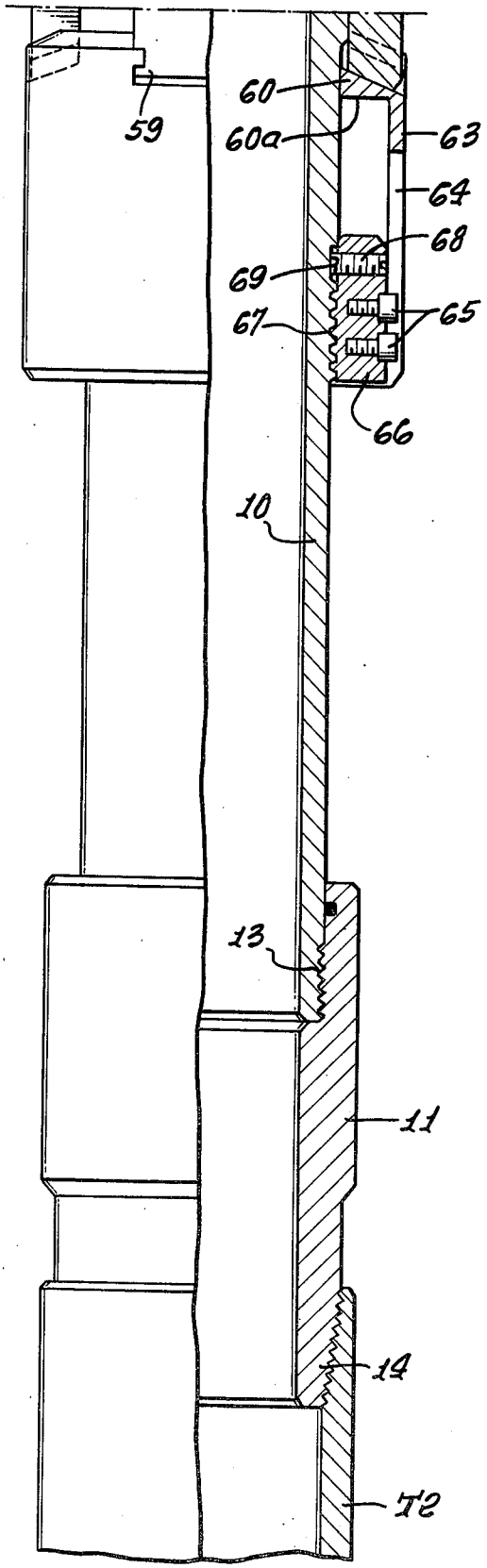

Referring to the drawings:

FIG. 1 is a diagrammatic view showing a retrievable, double grip well packer, in accordance with the invention, set in a well bore casing;

FIGS. 2*a*, 2*b*, 2*c*, and 2*d*, together, constitute a view partly in side elevation and partly in longitudinal section showing the well packer of FIG. 1 in condition for running into the well on a mechanical setting and retrieving tool, FIGS. 2*b* through 2*d* being successive downward continuations of FIG. 2*a;*

Figure 3D:
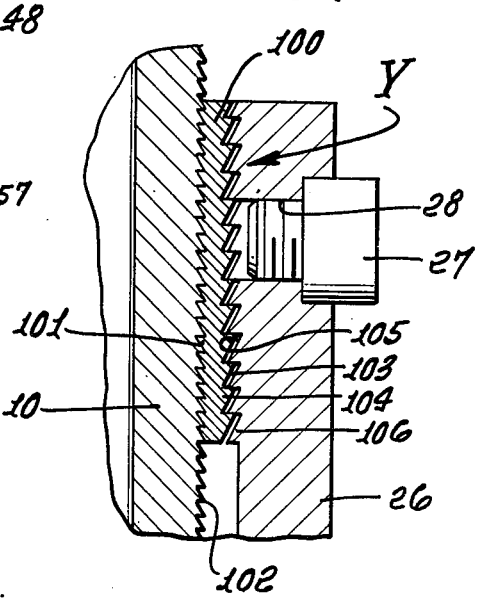
Figure 3A:
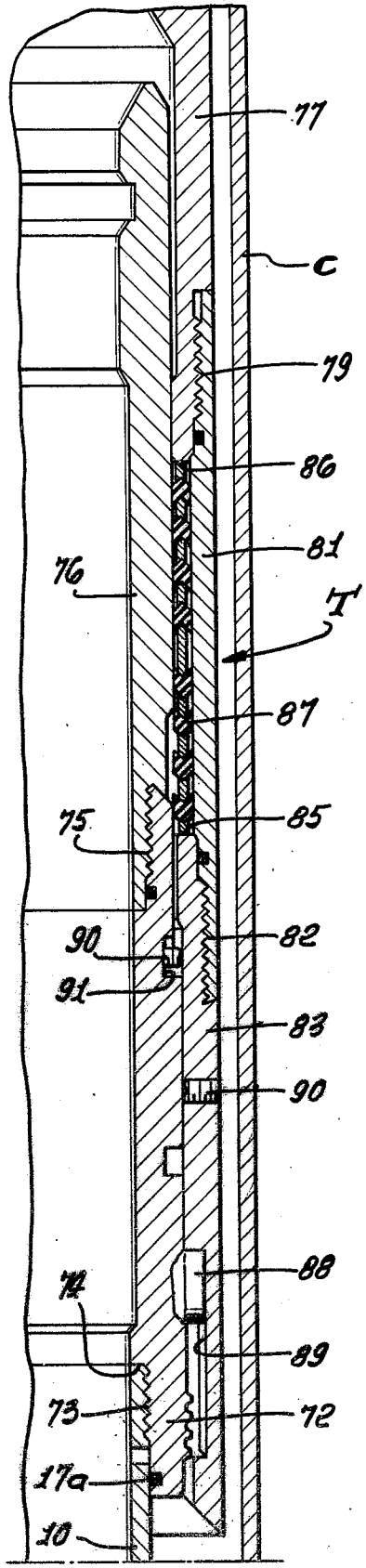
Figure 3B:
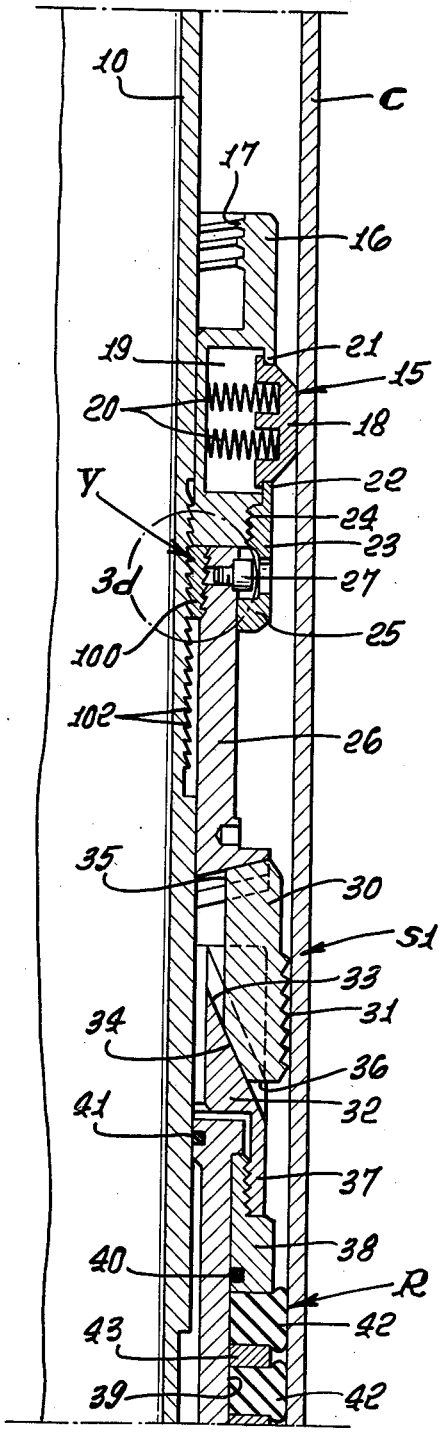
Figure 3C:
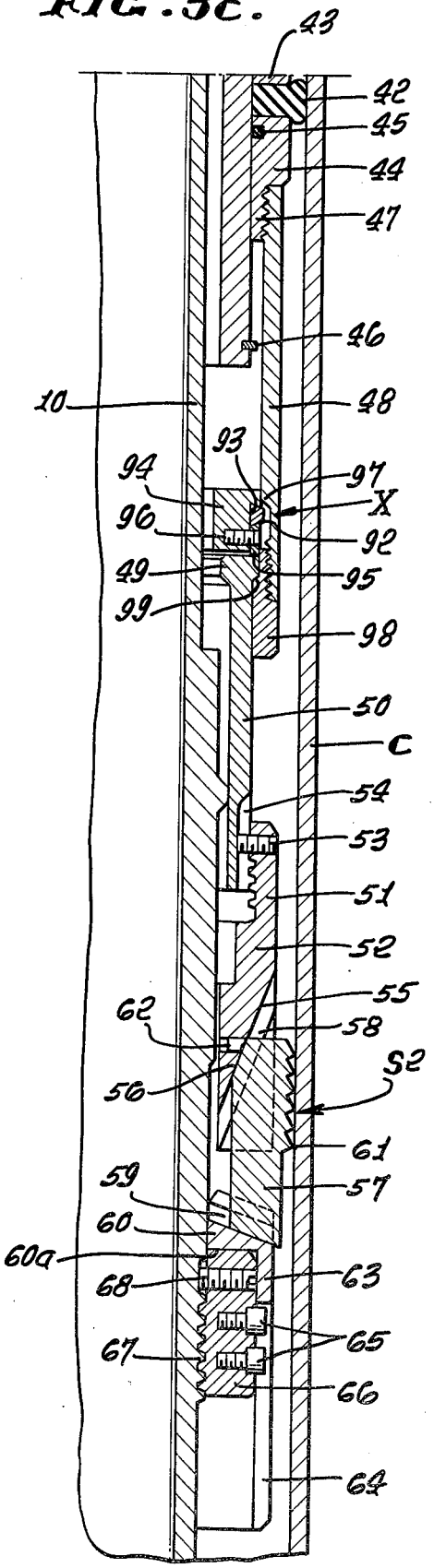

FIGS. 3*a*, 3*b*, and 3*c*, together, constitute a longitudinal quarter section of the well packer of FIGS. 2*a* through 2*d*, showing the well packer set in the well bore casing. FIGS. 3*b* and 3*c* being successive downward continuations of FIG. 3*a;*

FIG. 3*d* is an enlarged fragmentary detail view of the body lock embraced by the line 3*d* of FIG. 3*b;*

Figure 4C:
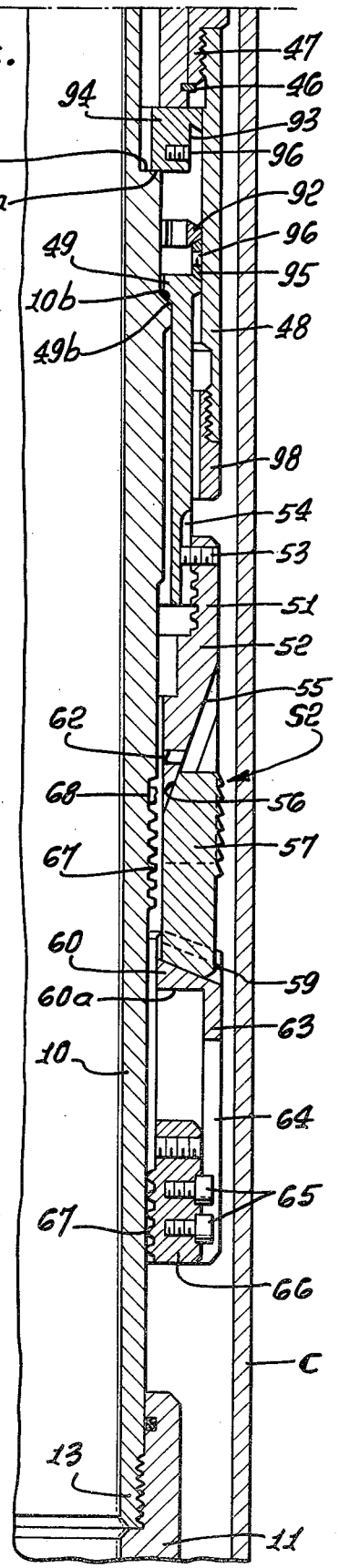
Figure 4A:
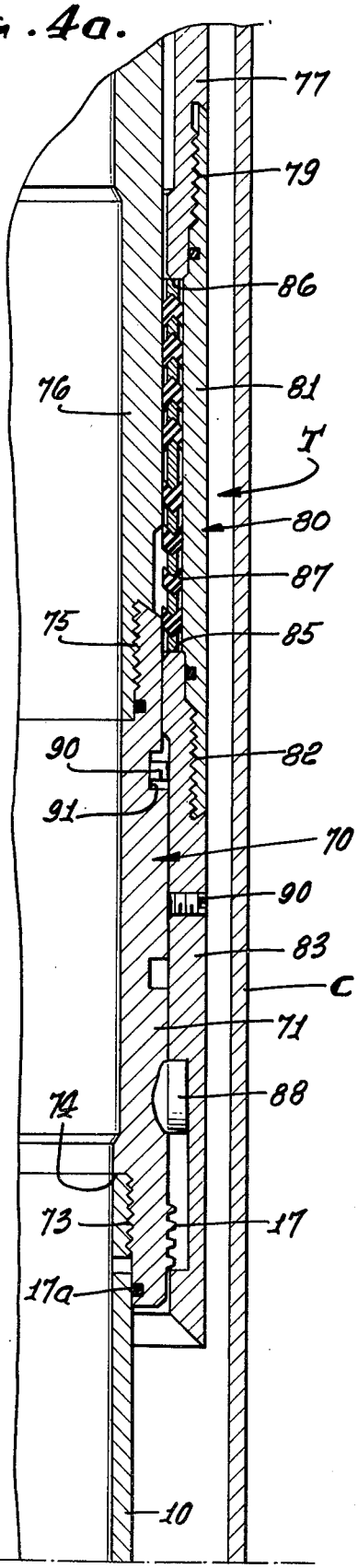
Figure 4B:
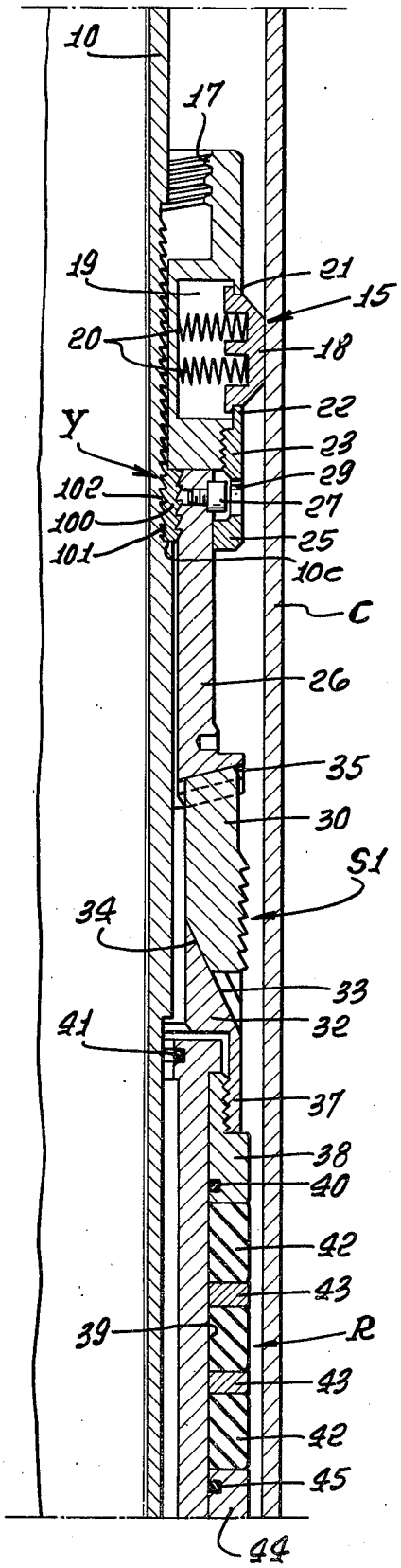

FIGS. 4*a*, 4*b*, and 4*c*, together, constitute a longitudinal quarter section showing the well packer of FIGS. 2*a* through 2*d* in a condition released for retrieval, FIGS. 4*b* and 4*c* being successive downward continuations of FIG. 4*a;*

Figure 6C:
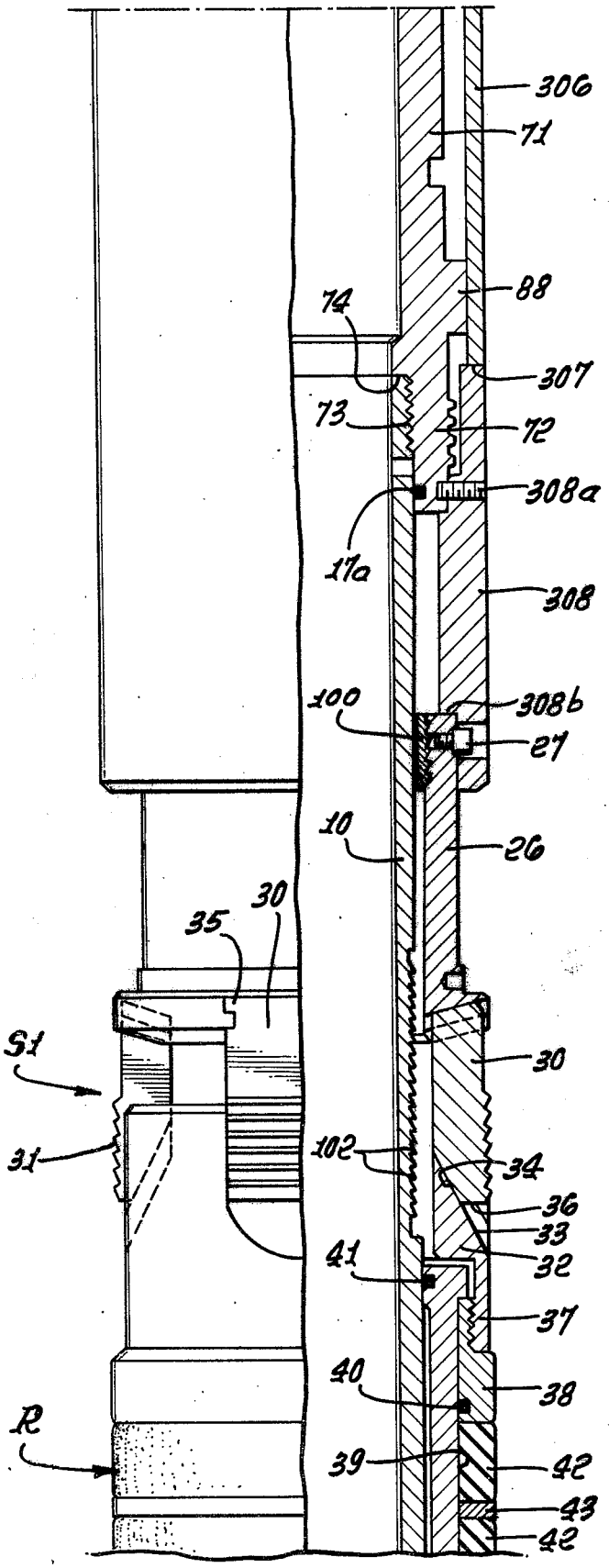
Figure 5A:
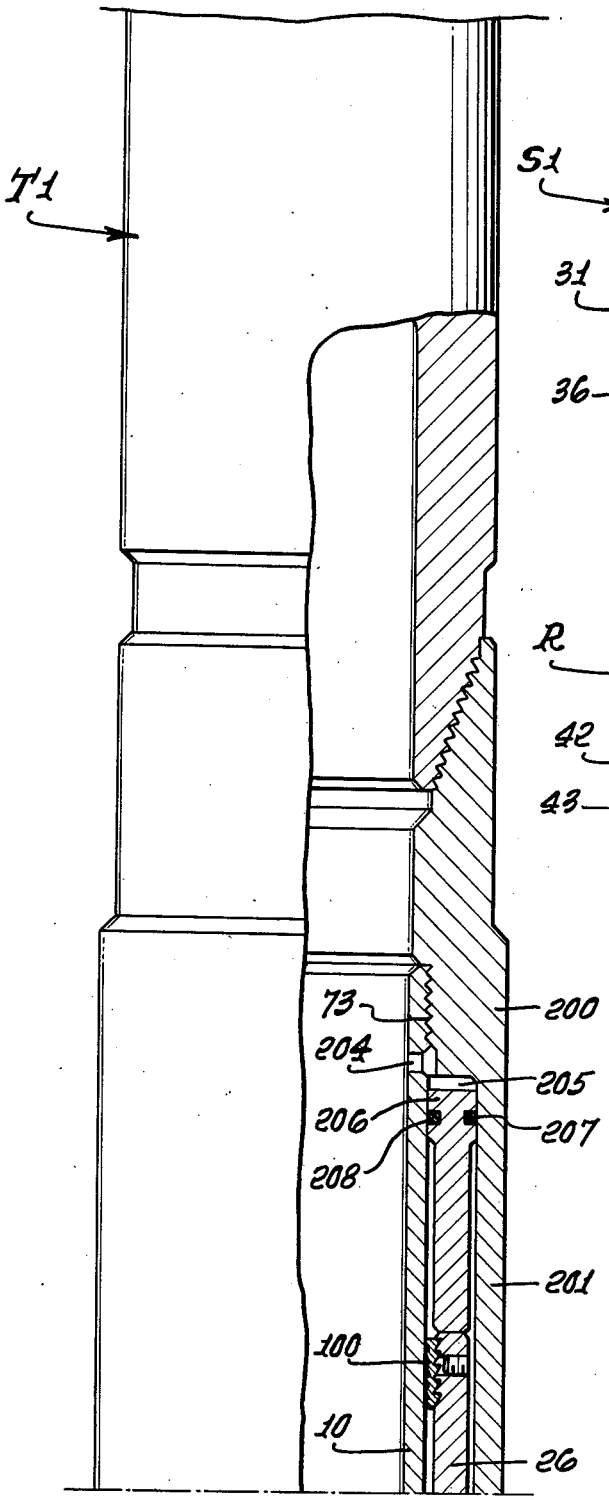
Figure 5B:
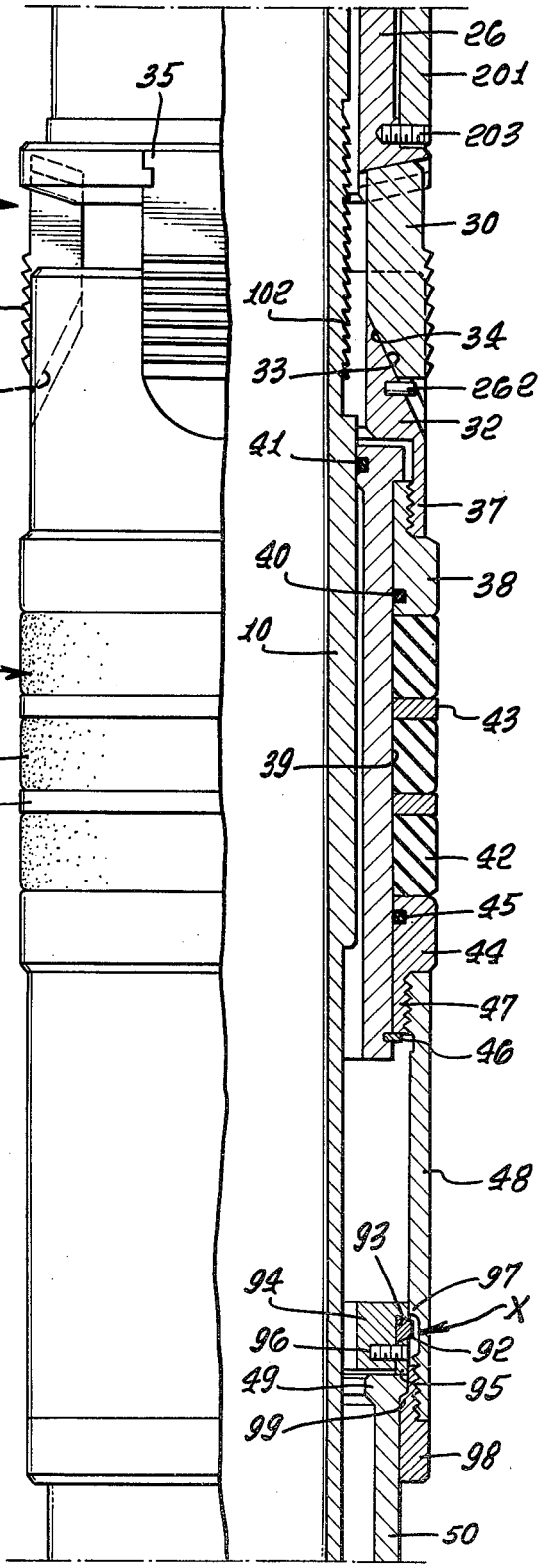
Figure 5C:
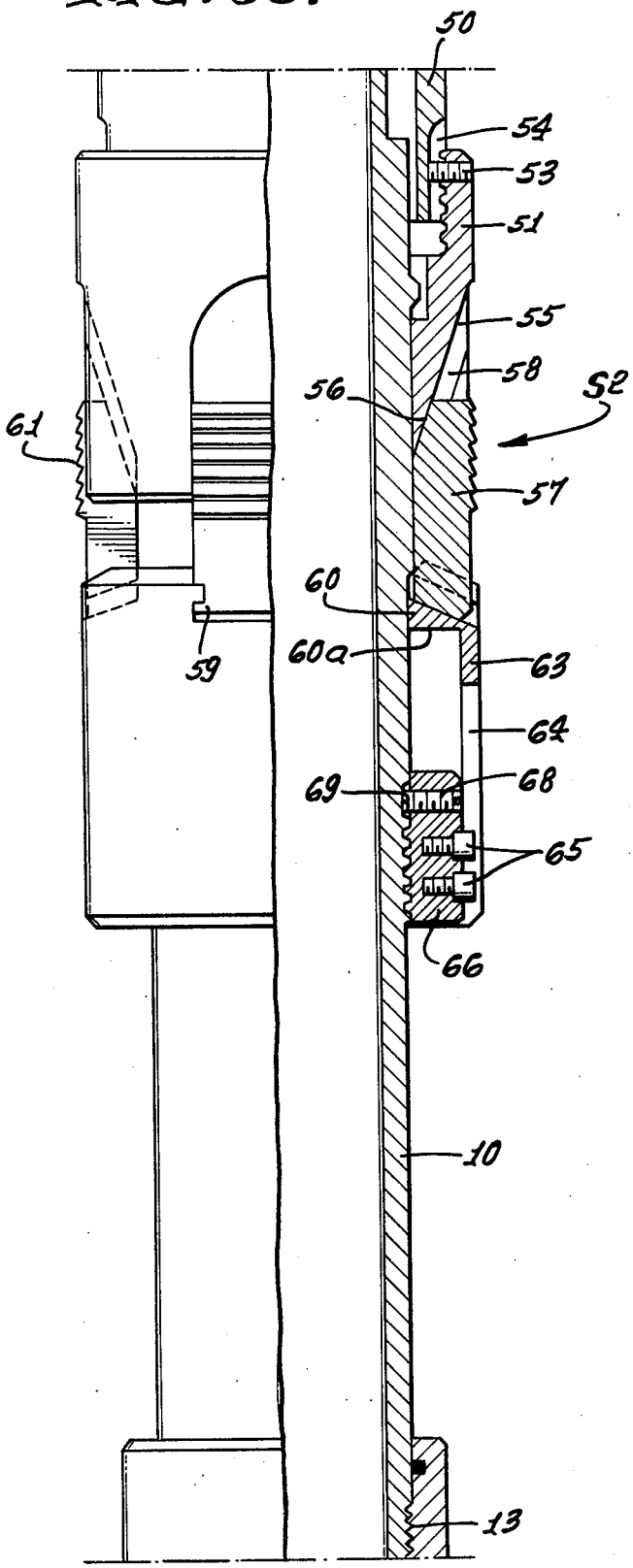
Figure 5D:
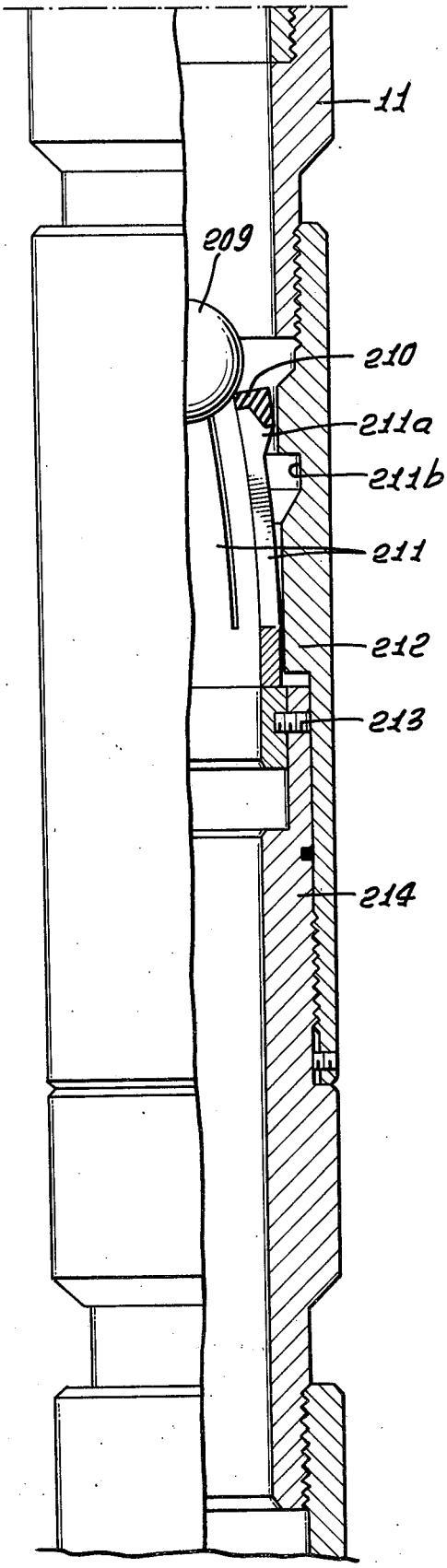
Figure 6A:
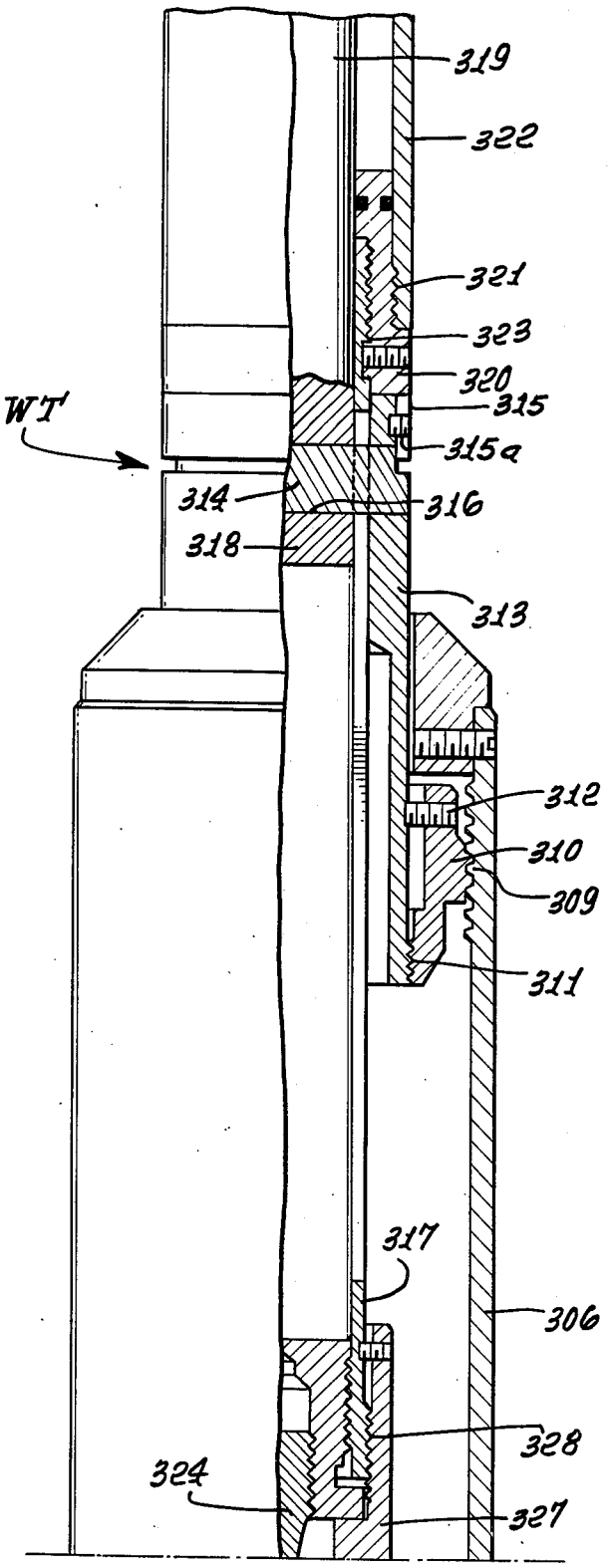
Figure 6B:
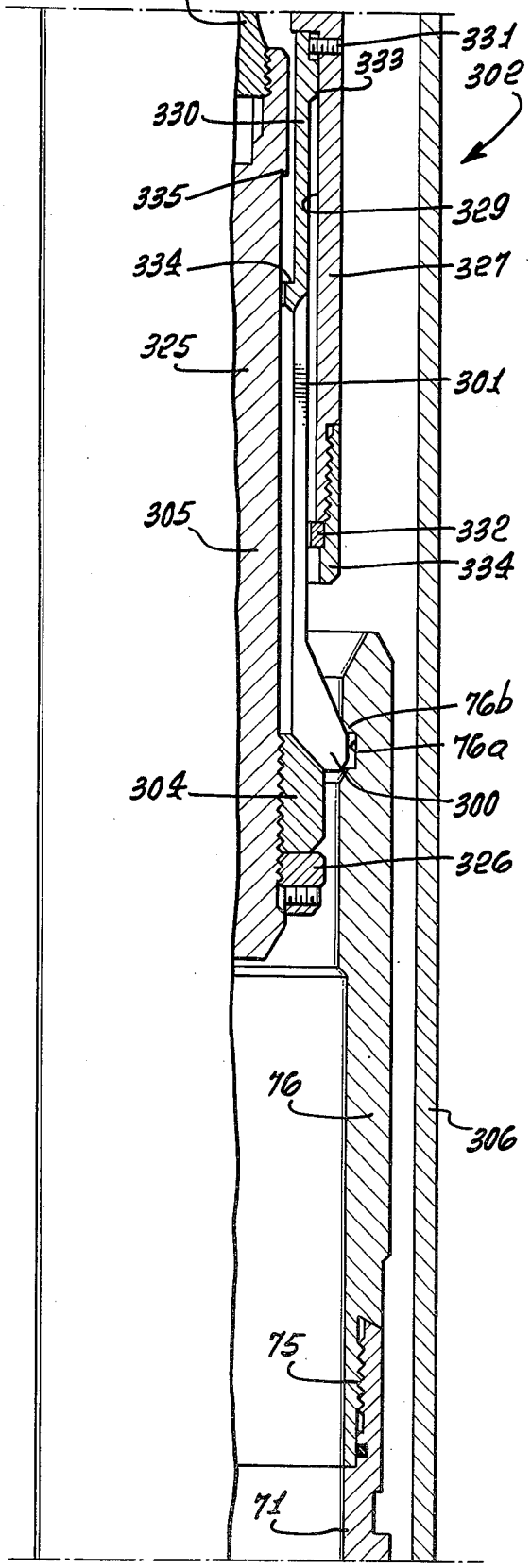

FIGS. 5*a*, 5*b*, 5*c*, and 5*d*, together, constitute a view partly in side elevation and partly in longitudinal section showing a well bore packer in accordance with the invention in the running in condition and modified to be set by fluid pressure, FIGS. 5*b* through 5*d* being successive downward continuations of FIG. 5*a;* and FIGS. 6*a*, 6*b*, and 6*c*, together, constitute a fragmentary view partly in side elevation and partly in longitudinal section showing the upper portion of the well bore packer in the running in condition and modified for setting on a wireline setting tool.

As seen in the drawings, a packer assembly P made in accordance with one preferred form of the invention is shown as being run into a well bore casing C on an upwardly extending pipe or tubing string T1, and suspends a downwardly extending length of pipe or tubing T2 within the well casing. Setting of the packer in the well casing has caused the outward expansion of upwardly holding, upper slips S1 and downwardly holding, lower slips S2 into anchoring engagement with the well casing, as well as the circumferential deformation of elastomeric packing means or rubbers R into sealing engagement with the well casing C.

Such packing assemblies are generally known as double holding packers, and the expansive force of the rubber packing elements, as well as fluid pressure acting on the structure maintains the slips of the upper and lower slip assemblies in tight anchoring engagement with the well casing, so that the weight of a running pipe or the downwardly extending pipe is not required to maintain the packing anchored. Pressure in the well casing below the set packer tends to even more tightly set the packer. However, such packers are characteristically difficult to release for retrieval due to the forces which tend to maintain the anchoring engagement of the slips. The present invention provides packing structure which is adapted to be easily set in the well casing, in the form of FIG. 1, FIGS. 2*a* through 2*d*, FIGS. 3*a* through 3*c*, and FIGS. 4*a* through 4*c*, by means of manipulation of the running in string of pipe; in the form shown in FIGS. 5*a* through 5*d* by the application of hydraulic setting fluid pressure through the running string of pipe; and in the form of FIGS. 6*a* through 6*c* by means of the opposite forces applied by a wire line setting tool.

Referring to FIGS. 2*a* through 2*d*, the packer is shown in the running in condition, prior to actuation to set the upper and lower slips and the packing means against the well casing. The packer assembly includes an inner elongated tubular body 10, connected at its upper end to a connector assembly including a running tool T, which is in turn threadedly connected at its upper end to the running in string of pipe T1. At its lower end, the elongated packer body 10 is connected by a bottom sub 11 to the downwardly extending string of pipe or tubing T2. This sub 11 has internal threads 13 for connection to the threaded lower end of the packer body and an externally threaded lower pin 14 for connection to the threaded upper end of the pipe string T2. Disposed about the body 10 and spaced longitudinally thereof, are the upwardly holding slip means S1 and the downwardly holding slip means S2, the resilient packing means R being disposed between the axially spaced slip means.

Disposed above the upper slip means S1 is a friction drag block assembly 15 providing means engageable with the well casing during setting of the packer to cause expansion of the slips and packing as the body moves axially. The drag block assembly includes a drag block housing 16 threadedly connected to the lower end of the connector means by a left hand thread 17 and having therein a number of circumferentially spaced drag blocks 18 disposed in radially opening windows 19 within the housing and normally biased outwardly by coil springs 20 disposed between the drag blocks and the bottom of the window. Outward projection of the drag blocks by the springs is limited by a lip 21 on the housing at one end of the drag blocks and by a lip 22 on a slip ring booster or swivel 23 which is threaded at 24 to the drag block housing, at one end, and has its other end 25 rotatably disposed about the upper end of an upper slip ring or sleeve 26. The lower end 25 of the swivel member is retained in coupled relation to the upper end of the slip ring 26 by the heads 27 of cap screws threaded into a number of circumferentially spaced threaded, radial holes 28 in the body 10. Access holes 29 for a tool are provided in the swivel member.

The slip ring 26 supports a plurality of circumferentially spaced upper slip elements 30 having upwardly facing wickers or teeth 31 thereon adapted to bite into the casing, upon outward expansion of the slip elements under the influence of an upper cone 32 having an angular outer surface 33 extending upwardly and inwardly and engageable beneath the companion angular surface 34 of the slip elements. The slip elements are interconnected between the upper slip ring and the cone by a T-head connection 35 between the slip ring and the upper end of the slip elements and a dove tailed fit 36 between the lower end of the slip elements and the cone, the relative angles of which permit the slip elements to be radially outwardly expanded into engagement with the casing and retracted upon movement of the cone surface in opposite directions beneath the slips.

The upper cone 32 has a threaded skirt 37 engaged with a companion threaded neck on a gage ring 38 which is axially slidably disposed about the outer cylindrical surface 39 of a packing sleeve. Between the gage ring and the outer periphery of the packing sleeve is an elastomeric seal ring 40 and another elastomeric seal ring 41 is disposed between the packing sleeve and the cylindrical outer portion of the body surrounded by the packing sleeve. Disposed about the packing sleeve is a suitable number of annular resilient elastomeric packing rings 42 and intermediate packing ring spacers 43, these packing rings and spacers being confined axially between the upper gage ring 38 and a lower gage ring 44 which is also disposed about the outer cylindrical surface of the packing sleeve and has an internal side or O-ring seal 45 slidably engaged with the packing sleeve. The respective gage rings and packing rings and spacers are held in assembly on the packing sleeve by a suitable retainer ring 46 engaged in a groove adjacent the lower end of the packing sleeve.

Threadedly connected to the skirt 47 of the lower gage ring is an elongated support sleeve 48 which extends downwardly about the upper end 49 of an elongated tubular support mandrel 50. Mounted on the lower end of the support mandrel 50 is an upwardly opening threaded neck 51 on the lower cone 52, this threaded connection is fixed by suitable retaining set screws 53 carried by the cone and extending into slots 54 in the mandrel 50. The lower cone 52 of the downwardly holding slip means S2 has an inclined surface 55 extending downwardly and upwardly and slidably engageable beneath the companion inclined surface 56 on the inner upper ends of the lower slip elements 57. These slip elements have a dove tail connection 58 with the lower cone and a T-head connection 59 with a lower slip support ring or sleeve 60, enabling ease of lateral expansion of the lower slip elements to effect biting of the downwardly holding teeth or wickers 61 thereon against the casing, when the packer is set. For a purpose which will appear hereinafter, frangible means or shear pins 62 are disposed in the lower cone in the path of the upper ends of the lower slips so as to initially prevent expansion of the lower slips into engagement with the casing.

The support sleeve 48 and the support mandrel 50 are initially held in a telescopically extended condition, as seen in FIG. 2*c*, by releasable means X to be later described, so that in the extended condition, the sleeve 48 and mandrel 50 are effectively a tubular spacer or connection between the packing gage ring 44 and the lower cone 52 through which setting forces are transmitted and maintained, until retrieval of the packer is to be effected.

Extending downwardly from the lower slip ring 60 is a tubular skirt 63 having a number of radially opening elongated slots 64 receiving the heads of a number of cap screws 65 which form a keyed connection enabling relative longitudinal movement between the lower slip ring and a support nut 66 which is disposed within the slip ring skirt 63 and connected to the body 10 by a left hand thread 67. The nut is locked in place on the body by a shear screw 68 extending through the lock nut into a recess 69 in the outer periphery of the body to normally prevent threaded rotation of the support nut on the body.

Connected to the upper end of the tubular body 10 is connecting means 70 having a connector sleeve 71 providing an internally threaded cylindrical portion 72 engaged with the companion right hand thread 73 at the upper end of the body, the connector sleeve having a downwardly facing shoulder 74 shouldering against the upper end of the body. The connector sleeve 71 has a left hand threaded connection 17 with the drag block housing 16. At its upper end the connector sleeve 71 is threadedly connected at 75 to the lower end of an upwardly extending tubular slick joint or seating nipple 76.

The connecting tool T is adapted to be installed upon the connector sleeve 71 and slick joint 76 and to be releasably connected thereto and form a seal therewith. At its upper end, the tool T has a connector sub 77 threadedly connected at its upper end to the running pipe or tubing T1 and threadedly connected at its lower end at 79 to the tubular body structure 80 which surrounds the slick joint and the connector sleeve.

This body structure 80 includes a seal sleeve 81 threadedly connected at its lower end 82 to a downwardly extending outer connector sleeve 83, the latter shouldering at 84 against the drag block housing 16. Between an upwardly facing shoulder 85 provided by the outer connector sleeve and a downwardly facing shoulder 86 provided by the sub 77 the seal sleeve 81 has suitable sealing means, shown as chevron packing 87 engageable with the outer cylindrical surface of the slick joint 76. The releasable connecting means between the inner and outer connector sleeve 71 and 83 comprises one or more radial pins 88 projecting radially from the inner sleeve 71 and engageable in an inverted J slot 89 in the outer sleeve 83, whereby the pipe string T1 supports the packer assembly.

In addition, for a purpose which will be later described, frangible means, shown as a shear pin 90, carried by the connector sleeve 83 and extending into a recess 91 in the inner connector sleeve, initially hold the connector means 70 against relative movement between the packer body 10 and the drag block means 15. Under these conditions, the packer can be lowered into the well casing to a setting location, with all of the external parts held stretched out along the body by the releasable means X between the telescopic packing support sleeve 48 and support mandrel 50.

This releasable means X includes a segmented abutment ring 92 disposed in a dove tail groove 93 in a support ring 94, the lower side of the groove 93 being formed by a ring 95 secured to the support ring 94 by a number of circumferentially spaced suitable shear pins or screws 96. Within the lower portion of the packing support sleeve 48 is a downwardly facing shoulder 97, above the abutment ring 92, and engageable therewith when the packer is being retrieved, as is later described. Assembly of the releasable means X is enabled by the lower end ring 98 being threaded into the lower end of the support sleeve 48, this end ring 98 shouldering at 99 with the head 49 of the support mandrel 50 and preventing separation thereof.

The packer assembly also incorporates body locking means Y adapted, when the packer is set, as will be later described, to lock the packer against release by undesired downward movement of the body 10, under the weight of the pipe T2 and/or high fluid pressure above the body. Such a body lock is more particularly the subject of the prior United States Patent granted J. R. Baker, et al., No. 2,647,584, granted Aug. 4, 1953.

As seen in FIGS. 2*b*, 3*b*, and 3*d*, the body locking means Y comprises a split, resilient lock ring or sleeve 100 carried by the slip ring support 26 and having internal ratchet teeth 101 engageable with external ratchet teeth 102 on the packer body 10 when, as will be later described, the body is moved upwardly (FIGS. 3*b* and 3*d*) through the ring 100, during setting of the packer.

As stated above, the well packer is set by relative upward movement of the body 10. Such relative movement can occur without interference since the internal ratchet teeth 101 on the lock sleeve 100 merely ratchet over the corresponding ratchet teeth or roughened surface 102 of the body, without a substantial resistance to its movement. However, any tendency for the body 10 to move in a downward direction with the upper slip ring 26, or for the slip ring to move in an upward direction with respect to the body, is prevented by the locking engagement of the internal teeth of the lock sleeve with the roughened surface or teeth of the body. In effect, the ring or sleeve 100 operates as a one-way coupling or clutch element, permitting relative upward movement of the body 10, but precluding its relative downward movement. Any tendency for the ring 100 to move downwardly with the body is resisted by wedging of the tapered cam surfaces 103 of its teeth 104 with the companion cam faces 105 forming the inclined surfaces of the buttress threads 106 in the slip ring 26. Such wedging action urges the ring 100 inwardly into the body 10 with a greater force.

When the packer is to be set, as seen in FIGS. 3*a* through 3*c*, following lowering of the packer on the running string to the setting depth, the drag blocks 18 of the drag block assembly 15 will resist rotation of the drag block housing 16 so that right hand rotation of the running in string will effect a disconnection of the left hand thread 17 between the drag block housing and the connector sleeve 71, torque being transmitted through the J slot sleeve 83 to the connector sleeve, and the upper slip ring 26 swiveling with respect to the drag block housing so that the entire outer assembly below the drag block housing will be rotated with the connector sleeve 71 through the right hand thread 73 which connects the connector sleeve to the upper end of the body.

Following release of the drag block housing from the outer connector sleeve, the frictional engagement of the drag blocks 18 within the casing will prevent upward movement of all of the assemblage below the drag blocks on the exterior of the body, when the body is elevated by raising the tubing T1. Elevation of the body 10 of the packer moves the bottom nut 66 into engagement with the downwardly facing shoulder 60*a* within the lower slip ring 60, thereby tending to move the structure external of the body upwardly against the resistance afforded by the drag block assembly. The lower slips 56 are initially prevented from expanding outwardly by engagement of the slip ends with the shear pins 62 so that the thrust on the external assembly is transmitted through the pins 62 to the support mandrel 50 and from the support mandrel through the releasable means including the segmented ring 92 in the outer periphery of the ring holder 94. The upward force is thus transmitted to the support sleeve 48 and thence to the lower gage ring 44 and through the packing elements 42, to the upper gage ring 38, to effect upward movement of the upper cone 33 beneath the upper slips 30 to force them radially outward into upwardly holding engagement with the well casing. Continued upward force deforms the packing elements axially and circumferentially outwardly into packed off engagement within the well casing, and thereafter the shear pin or pins 62 are sheared by the slips 57 so that the lower downwardly holding slips are then expanded outwardly into anchoring engagement with the well casing, and the packer assembly is firmly set and sealed within the well casing.

After the packer has been set, as just described, it is pressure energized. Pressure in the annular space above the packer acts downwardly on the area A1 between the outer cylindrical surface 39 of the packing sleeve and the inside diameter of the O-ring 41 where it seals on the outside diameter of the body more tightly setting the packing elements. This same pressure acts on the body area A2 between the inside diameter of the O-ring 41 and the outside diameter of the tubing T1 to force the body downwardly and urge the upper slips 30 into engagement with the upper cone 32, in the event that packing ring extrusion permits downward movement of the upper cone. Furthermore, fluid pressure from below, acting over the area A3 between the inside diameter of the O-ring 41 within the packing sleeve 39 and the inside diameter of the tubing can force the body upward and tighten the packing elements and lower slips through the support nut 66 and the lower slip ring 60.

Upward movement of the body during the setting action or in response to fluid pressure, results in engagement of the body lock ring means Y automatically locking the body as it moves longitudinally relative to the slip ring 26. Following the setting of the packer, as just described, the running in string of the tubing T1 can be released by setting down sufficient weight on the tubing to shear the shear screw 90 which interconnects the J-slot sleeve 83 with the connector sleeve 71, followed by rotation of the tubing to the left to disengage the J pin 88 from J slot 89 and then lifting up on the tubing.

When it is desired to release the packer, as seen in FIGS. 4*a* through 4*c*, the tool T can again be run in on the pipe string T1 and engaged with the connector sleeve 71. Right hand torque is applied to the body sufficient to shear the shear pin 68 which connects to the stop nut 66 to the body within the lower end of the lower slip ring 60. As illustrated, it will be noted that the stop nut is in engagement with the shoulder 60*a* within the lower slip ring 57, and the stop nut is held against rotation by the slip ring and the key means provided by the screws 65 engaging in the elongated slots 64 in the lower slip ring. However, rotation of the body effects downward movement of the stop nut 66 by the left hand thread 67, responsive to right hand rotation of the body, until the nut is released from the threads on the body, at which time the body is free to move upward.

Upward movement of the body causes engagement of an upwardly facing shoulder 10*a* thereon with the lower surface 94*a* of the ring holder 94 of the releasable connection between the support mandrel and the support sleeve, resulting in shearing of the shear pins 96 which connect the retaining ring 95 to the ring holder 94 and the shucking of the segmented ring 92 and the retaining ring from the ring holder, thereby enabling the ring holder to move upwardly with respect to the support sleeve 48. When the segmented connecting ring 92 is displaced from the ring holder, the support mandrel 50 and the support sleeve 48 are free to telescopically contract, thereby releasing the connection between the lower cone 52 and the support sleeve 48, which relieves the lower cone from the holding forces supplied thereto by the deformed packing elements. The packing elements can accordingly resume their contracted form and the force driving the lower cone under the lower slip is instantaneously relieved. As the body continues its upward movement, an upwardly facing shoulder 10*b* below the shoulder 94*a* on the body will engage a downwardly facing shoulder 49*b* on the support mandrel 50, thereby pulling the lower cone from beneath the lower slips and retracting the slips, due to the dove tail connection between the slips and the cone.

Such release of the packing elements also relieves the force holding the upper cone beneath the upper slips, so that as the body moves upwardly, a third upwardly facing shoulder 10*c* on the body will contact the body locking ring 100, and apply an upward pull to the upper slip ring 26 to retract the upper slips 30 from engagement with the casing.

As seen in FIGS. 5*a* through 5*d*, the packer of the invention is adapted to be set by fluid pressure supplied through the running pipe string. The packer assembly, from the upper end of the body 10, downwardly to the stop nut 66 is the same in most respects and similar reference characters are applied thereto.

The tubing T1 on which the packer is run into the well, has a cylinder head 200 threadedly connected thereto and having a downwardly extended cylinder skirt 201 disposed about the upper slip ring 26 and connected thereto by suitable fastenings 203 engaged therebetween. The cylinder head is also threadedly connected to the thread 73 at the upper end of the body. A radial port 204, FIG. 5*a* (which is sealed off by a seal 17*a* in FIG. 2*b*) extends from the passage through the body 10 into the annular cylinder space 205 between the cylinder head sleeve 201 and the outside diameter of the body, in which annular space an annular piston 206 is reciprocable. This annular piston has an outer side ring seal 207 engaged slidably with the cylinder head sleeve and an inner peripheral side ring seal 208 slidably engaging with the outer periphery of the body. At its lower end the annular piston is engageable with the upper end of the upper slip ring 26.

In this form, when fluid in the running string is to be pressurized, a sealing ball 209 is dropped through the running string and lands against an upwardly facing ball seat 210 provided at the upper ends of resilient fingers 211 provided within a pressure sub 212 connected to the lower end of the assembly. The ball seat is normally held in an upper position by shear screws 213 connecting the same to the lower body 214 of the sub so that fluid pressure in the tubing above the pressure sub can be elevated. Elevation of such fluid pressure, acting upon the annular piston 206 through the body ports leading to the annular piston chamber 205, results in a downward force being applied to the upper slip ring, which will shear the connecting screws 203 between the cylinder sleeve 201 and the upper slip ring 26, thereby enabling downward movement of the external packer structure with respect to the body, so that the parts assume the same relative position shown in FIGS. 3*a* through 3*c*. However, in this form, the shear pins 62 are omitted so that the lower anchor slips 57 are first expanded by the lower expander cone 52 into tight anchoring engagement with the casing, thereafter the packing elements being deformed and moved circumferentially into sealing engagement with the casing. Thereafter, the upper slips 30, which are initially prevented from expanding by shear screws 262 engaged in the upper cone 32 and thus limit movement of the upper slips on the upper cone, will be sheared to allow the upper slips to be forcefully wedged into engagement with the casing. The body lock ring 100, at this point, will be engaged with the locking teeth 102 on the body to prevent release of the packer.

After the packer has been fully set and anchored in the well casing the continued pressurization of fluid in the tubing string acting across the ball 209 seated on the tops of the fingers of the pressure sub, will cause the shear screws 213 therein to be sheared and the supporting sleeve for the fingers to move downwardly, allowing the outwardly projecting lugs 211*a* on the fingers to move outwardly into the inwardly opening groove 211*b* formed within the pressure sub body, the ball then passing through the sub.

Release of the packer can be accomplished simply by rotating the tubing T1 and the body 10 to the right, to release the left hand thread 67 between the nut 66 and the body following shearing of the shear pins 68 which connect the nut to the body, and thereafter the body can be moved upwardly, as previously described.

Another form of the invention is shown in FIGS. 6*a* through 6*c*. In this form, the packer is adapted to be run into the well casing on a wire line setting tool WT, the packer assembly being like that shown in FIGS. 2*a* through 2*d*, only the upper portion being shown and having the same reference numbers. Such wire line setting tools are well known and reference is made to U.S. Pat. No. 2,713,910 for a more detailed description of such a tool. However, the lower portion of such a tool is shown herein. It is notable, however, that in this form, the packer assembly is adapted to be actuated by the wire line setting tool WT by means of the connector sleeve 71 previously described and the upwardly extended slick joint 76 which are threaded to the body 10 as in the first described embodiment. Internally, the slick joint 76, adjacent its upper end, has an inwardly opening groove 76*a* defining a shoulder 76*b* facing downwardly and adapted for engagement by lugs 300 formed at the lower ends of resilient fingers 301 provided in the setting tool adapter means 302 and normally held outwardly beneath the shoulder by and expander 304 carried on the mandrel 305 of the setting tool. An outer sleeve 306 of the adapter extends downwardly about the connector sleeve 71 and abuts at its lower end 307 with the upper end of an adapter sleeve 308 which is connected to the connector sleeve 71 by shearable means or screws 308*a*. The lower end of the adapter sleeve 308 shoulders at 308*b* on the slip ring 26 and is retained therein by the cap screws 27. Thus, the outer components about the packer body 10 are stretched out on the body as the tool is being run into the well.

At its upper end, the adapter sleeve 306 is connected by threads 309 to an adapter nut 310 which is in turn threadedly connected at 311 and locked by a set screw 312 on the lower end of a thrust sleeve 313. At its upper end, the thrust sleeve 313 is slotted to receive a cross-piece 314 retained by a sleeve 315 and a set screw 315*a*, the cross-piece extending through slots 316 in a tubular mandrel section 317 and through the lower end 318 of an actuator rod 319 which is reciprocable in the mandrel section 317 and through the lower end of a cylindrical housing 322. The mandrel 317 is threadedly connected at 323 within the head 320. This structure is, in effect, a cross-over device, whereby downward thrust of the rod 319 is transmitted to the adapter sleeve 306, and thus to the upper slip ring 26 of the packer, during setting thereof, while upward thrust of the housing 322 is transmitted to the adapter mandrel 317, and thus, through the latch lugs 300 to the packer body 10.

The setting tool mandrel section 317 is threadedly connected to a frangible device or tension stud 324 which is also threadedly connected to the upper end of a mandrel rod 325 which extends downwardly within the latch fingers 301 and has the expander 304 formed or threaded thereon and locked in place by a suitable retainer 326. Also supported on the mandrel 317 is a downwardly extending latch support sleeve 327, threaded at 328 onto the mandrel 317. This latch support sleeve has a bore 329 receiving the upper ring end 330 of the latch fingers 301, a set screw or screws 331 normally holding the latch ring upwardly in the bore with the fingers 301 projecting from the lower end of the sleeve 329. At its lower end the sleeve 327 has an internal stop 332 provided by a ring retained in place by a retainer 334. This stop 332 confronts a downwardly facing external shoulder 333 on the latch ring 330, to catch the latch ring following setting of the packer. The latch ring 330 also has an internal shoulder 334 spaced downwardly from an external shoulder 335 on the mandrel rod 325 to catch the rod following setting of the packer.

As is well known, electric wire line setting tools have means for generating gas from a combustible fuel or pressure charge to provide a force acting on the housing 322 upwardly and on the rod 319 downwardly to provide motion for setting packers, as is more fully illustrated and described in the aforementioned U.S. Pat. No. 3,713,910. After the setting of the packer by the setting tool, the tension stud is pulled apart, enabling release of the tool from the packer body.

This same action occurs in the case of the present invention. Activation of the wire line setting tool creates a pressure charge which causes downward movement of the outer adapter sleeve 306, shearing screw 308*a* and acting downwardly on the upper slip ring 26. As the relative longitudinal movement occurs, the shear pins 62 between the lower slips 57 and the lower cone 52 prevent expansion of the lower slips until the upper slips 30 have first been expanded and anchored in engagement with the casing and the packer elements 42 have then been deformed and expanded into sealing contact with the casing. Thereafter, the shear pins between the lower slips and the lower cone will be sheared to permit the lower slips to be fully expanded into anchoring engagement with the casing.

The wire line setting tool can then be removed from the packer assembly after it is fully packed off and following breaking of the tension stud 324. When the stud 324 breaks, the mandrel rod 325 drops down and is caught by the shoulder 335 thereon engaging the latch ring shoulder 334. The fingers 301 can then flex inwardly to release the setting tool from the packer assembly, and the shoulder 333 on the ring 330 will be caught upon the lower stop ring 332.

When the packer is to be retrieved, the previously described running tool T is lowered on the tubing T1 and engaged with the connector sleeve 71 so as to enable release of the packer.

From the foregoing, it will be apparent that the invention provides an improved double holding well casing packer of the double holding type which is capable of being set and holding against very high differential pressure, but yet is easy to retrieve due to the releasable support between the packing elements and the slips. The packer, moreover, is versatile in that it is susceptible to operation by manipulation of the running pipe string, by fluid pressure, or by a pressure setting tool. Such well packers are capable of use in a variety of applications in a well bore, including production testing, fluid injection, and zone isolation, or as a bridge plug, wherein the packer is tightly set by tubing weight and/or differential pressure.

I claim:

1. In a double holding well casing packer assembly: an elongated body; upwardly holding slip means expansible outwardly from said body into anchoring engagement with the casing; downwardly holding slip means expansible outwardly from said body into anchoring engagement with the casing; resilient packer means deformable between said body and said slip means into sealing engagement with the casing; and means for expanding said slip means and resiliently deforming said packer means responsive to relative longitudinal movement of said body and said packer means in one direction, including releasable means between said packer means and one of said slip means; and means for releasing said releasable means responsive to additional relative longitudinal movement of said body and said packer means in the same direction.

2. In a double holding packer as defined in claim 1; means for relatively longitudinally shifting said body and said slip means and packer means.

3. In a double holding packer as defined in claim 1; means for relatively shifting said body and said slip means and packer means, including means connected to said body and to one of said slip means for applying opposite axial forces thereto.

4. In a double holding packer as defined in claim 1; means for relatively shifting said body and said slip means and packer means, including casing engaging friction means connected to one of said slip means, and connector means on said body releasably connected to said friction means and connectible with a running in string of pipe.

5. In a double holding packer as defined in claim 1; means for relatively shifting said body and said slip means and packer means including cylinder means connected to said body and releasably connected to one of said slip means; a piston in said cylinder means acting on said one of said slip means; and means for admitting pressure fluid from said body into said cylinder means to act on said piston.

6. In a double holding packer as defined in claim 1; means for relatively shifting said body and said slip means including pressure setting tool means releasably connected to said body and operable to apply opposite forces to said body and to said one of said slip means.

7. In a double holding packer as defined in claim 1; means for relatively shifting said body and said slip means and packer means, and locking means for holding said body and said slip and packer means relatively shifted.

8. In a double holding packer as defined in claim 1; means for relatively shifting said body and said slip means and packer means, including means connected to said body and to one of said slip means for applying opposing axial forces thereto, and releasable means initially preventing expansion of said one of said slip means until after expansion of the other of said slip means.

9. In a double holding packer as defined in claim 1; means for relatively shifting said body and said slip means and packer means, including means connected to said body and to one of said slip means for applying opposing axial forces thereto, and releasable means preventing expansion of the other of said slip means until after expansion of said one of said slip means.

10. In a double holding well casing packer as defined in claim 1; means engageable between said body and the other of said slip means for preventing said additional longitudinal movement of said body and disengageable to permit such additional movement of said body in response to rotation of said body.

11. In a double holding well casing packer as defined in claim 1; means engageable between said body and the other of said slip means for preventing said additional longitudinal movement of said body and disengageable to permit such additional movement of said body in response to rotation of said body, said means for releasing said releasable means including coengageable portions of said body and said releasable means engageable upon said additional longitudinal movement of said body.

12. In a double holding well casing packer as defined in claim 1; means engageable between said body and the other of said slip means for preventing said additional longitudinal movement of said body and disengageable to permit such additional movement of said body in response to rotation of said body, said means for releasing said releasable means including coengageable portions of said body and said releasable means engageable upon said additional longitudinial movement of said body, said body and said slip means having coengageable means for retracting said slip means upon continued longitudinal movement of said body following release of said releasable means.

13. In a double holding well casing packer as defined in claim 1; means engageable between said body and the other of said slip means for preventing said additional longitudinal movement of said body and disengageable to permit such additional movement of said body in response to rotation of said body, said means for releasing said releasable means including coengageable portions of said body and said releasable means engageable upon said additional longitudinal movement of said body, said body and said slip means having coengageable means for first retracting said downwardly holding slip means and then retracting said upwardly holding slip means upon continued longitudinal movement of said body following release of said releasable means.

14. In a double holding well casing packer as defined in claim 1; a first threaded connection between said body and one of said slip means disengageable by rotation of said body to allow such longitudinal movement of said body and said packer means to enable expansion of said slip means, a second threaded connection between said body and the other of said slip means disengageable by additional rotation of said body to allow said additional longitudinal movement of said body, and means preventing disengagement of said second threaded connection by rotation of said body to disengage said first threaded connection.

15. In a double holding well casing packer as defined in claim 14; said means preventing disengagement of said second threaded connection including a shearable connection.

16. In a double holding well casing packer as defined in claim 14; said second threaded connection including a nut threadedly engaged with one of said body and said other of said slip means and a sliding rotary drive between said nut and the other of said body and said other of said slip means.

17. In a double holding well casing packer as defined in claim 1; a first threaded connection between said body and one of said slip means disengageable by rotation of said body to allow said longitudinal movement of said body and said packer means to enable expansion of said slip means, a second threaded connection between said body and the other of said slip means disengageable by additional rotation of said body to allow said additional longitudinal movement of said body, and means preventing disengagement of said second threaded connection by rotation of said body to disengage said first threaded connection, said means for releasing said releasable means including coengageable portions of said body and said releasable means engageable upon said additional longitudinal movement of said body.

18. In a double holding well casing packer as defined in claim 1; a first threaded connection between said body and one of said slip means disengageable by rotation of said body to allow said longitudinal movement of said body and said packer means to enable expansion of said slip means, a second threaded connection between said body and the other of said slip means disengageable by additional rotation of said body to allow said additional longitudinal movement of said body, and means preventing disengagement of said second threaded connection by rotation of said to body to disengage said first threaded connection, said means for releasing said releasable means including coengageable portions of said body and said releasable means engageable upon said additional longitudinal movement of said body, said body and said slip means having coengageable means for retracting said slip means upon continued longitudinal movement of said body following release of said releasable means.

19. In a double holding well casing packer as defined in claim 1; a first threaded connection between said body and one of said slip means disengageable by rotation of said body to allow said longitudinal movement of said body and said packer means to enable expansion of said slip means, a second threaded connection between said body and the other of said slip means disengageable by additional rotation of said body to allow said additional longitudinal movement of said body, and means preventing disengagement of said second threaded connection by rotation of said body to disengage said first threaded connection, said means for releasing said releasable means including coengageable portions of said body and said releasable means engageable upon said additional longitudinal movement of said body, said body and said slip means having coengageable means for first retracting said downwardly holding slip means and then retracting said upwardly holding slip means upon continued longitudinal movement of said body following release of said releasable means.

20. In a double holding well casing packer as defined in claim 1; means engageable between said body and the other of said slip means for preventing said additional longitudinal movement of said body and disengageable to permit such additional movement of said body in response to rotation of said body, said means for releasing said releasable means including coengageable portions of said body and said releasable means engageable upon said additional longitudinal movement of said body.

21. In a double holding well casing packer as defined in claim 1; means engageable between said body and the other of said slip means for preventing said additional longitudinal movement of said body and disengageable to permit such additional movement of said body in response to rotation of said body, said means for releasing said releasable means including coengageable portions of said body and said releasable means engageable upon said additional longitudinal movement of said body, said body and said slip means having coengageable means for retracting said slip means upon continued longitudinal movement of said body following release of said releasable means.

22. In a double holding well casing packer as defined in claim 1; means engageable between said body and the other of said slip means for preventing said additional longitudinal movement of said body and disengageable to permit such additional movement of said body in response to rotation of said body, said means for releasing said releasable means including coengageable portions of said body and said releasable means engageable upon said additional longitudinal movement of said body, said body and said slip means having coengageable means for first retracting said downwardly holdig slip means and then retracting said upwardly holding slip means upon continued longitudinal movement of said body following release of said releasable means.

23. In a double holding well casing packer assembly: an elongated body; deformable packing means disposed about said body and expansible into sealing engagement with the casing; upper slip means above said packing means including an upper slip ring shiftably disposed about said body and having slip elements expansibly and retractably supported thereby; lower slip means below said packing means including a lower slip ring shiftably disposed about said body and having slip elements expansibly and retractably supported thereby; said upper and lower slip means including expander members engaged between said slip elements; and said packing means including a telescopic support between the expander of said lower slip means and said packing means; means releasably holding said telescopic support extended; first disconnectable means connecting said upper slip ring to said body; second disconnectable means connecting said lower slip ring to said body including means for preventing disconnection during disconnection of said first disconnectable means, whereby relative longitudinal movement of said body with respect to said packing means expands said slip elements; said body and said means releasably holding said telescopic support extended having coengageable means releasing said telescopic support for contraction upon upward movement of said body following disconnection of said second disconnectable means, and means for retracting said upper and lower slips upon further upward movement of said body.

24. In a double holding packer as defined in claim 23; means for relatively longitudinally shifting said body and packer means.

25. In a double holding packer as defined in claim 23; means for relatively shifting said body and packer means, including means connected to said body and to one of said slip means for applying opposing axial forces thereto.

26. In a double holding packer as defined in claim 23; means for relatively shifting said body and packer means, including casing engaging friction means connected to one of said slip means, and connector means on said body releasably connected to said friction means and connectible with a running in string of pipe.

27. In a double holding packer as defined in claim 23; means for relatively shifting said body and packer means including cylinder means connected to said body and releasably connected to one of said slip means; a piston in said cylinder means acting on said one of said slip means; and means for admitting pressure fluid from said body into said cylinder means to act on said piston.

28. In a double holding packer as defined in claim 23; means for relatively shifting said body and said packer means including pressure setting tool means releasably connected to said body and operable to apply opposite forces to said body and to said one of said slip means.

29. In a double holding packer as defined in claim 23; means for relatively shifting said body and packer means, and locking means for holding said body and said slip and packer means relatively shifted.

30. In a double holding packer as defined in claim 23; means for relatively shifting said body and packer means, including means connected to said body and to one of said slip means for applying opposing axial forces thereto, and releasable means initially preventing expansion of said one of said slip means until after expansion of the other of said slip means.

31. In a double holding packer as defined in claim 23; means for relatively shifting said body and packer means, including means connected to said body and to one of said slip means for applying opposing axial forces thereto, and releasable means preventing expansion of the other of said slip means until after expansion of said one of said slip means.

32. In a double holding packer as defined in claim 23; said upper slip ring and said body having means connectable with means for effecting said longitudinal movement of said body.

33. In a double holding packer as defined in claim 23; said upper slip ring and said body having means connectable with means for effecting said longitudinal movement of said body including a connector sleeve having J-means connectable with a retrieving tool.

34. In a double holding packer as defined in claim 23; said upper slip ring and said body having means connectable with means for effecting said longitudinal movement of said body, including means for releasably connecting said upper slip ring with said means for effecting said longitudinal movement.

35. In a double holding packer as defined in claim 23; said upper slip ring and said body having means connectable with means for effecting said longitudinal movement of said body, including left hand thread means for releasably connecting said upper slip ring with said means for effecting said longitudinal movement.

36. In a double holding packer as defined in claim 23; said means releasably holding said telescopic support extended including frangible means carried by one telescopic support member and engageable by another telescopic support member.

37. In a double holding packer as defined in claim 23; said means releasably holding said telescopic support extended including frangible means carried by one telescopic support member and engageable by another telescopic support member, said coengageable means on said body and said means releasably holding said telescopic support extended including a shoulder on said body engageable with said frangible means.

38. In a double holding packer as defined in claim 23; said means releasably holding said telescopic support extended including a carrier ring on one telescopic support member, frangible means on said carrier ring, and another telescopic support member engaging said carrier ring.

39. In a double holding packer as defined in claim 23; said means releasably holding said telescopic support extended including a carrier ring on one telescopic support member, frangible means on said carrier ring, and another telescopic support member engaging said carrier ring, said coengageable means on said body and said means releasably holding said telescopic support extended including a shoulder on said body engageable with said carrier ring.

40. In a double holding well casing packer comprising an elongated body; oppositely holding casing engaging slip means and resilient casing engaging packing means on said body engageable with the casing upon relative longitudinal movement of said body and said slip and packing means in one direction; said packing means and body imposing forces on said slip means preventing release of said slip means; a contractible support between said packing means and one of said slip means having releasable means permitting contraction of said support and release of said slip means; and means on said body for releasing said releasable means upon additional longitudinal movement of said body relative to said support in the same direction.

41. In a double holding well casing packer as defined in claim 40; said contractible support comprising a pair of telescopic sleeves between said packing means and said one of said slip means, said releasable means holding said sleeves extended and allowing contraction of said sleeves upon release by said body.

42. In a double holding well casing packer as defined in claim 40; said contractible support comprising a pair of telescopic sleeves between said packing means and said one of said slip means, said releasable means including an abutment member engaged with one of said sleeves and frangible support means for said abutment member engaged by the other of said sleeves.

43. In a double holding well casing packer as defined in claim 40, said contractible support comprising a pair of telescopic sleeves between said packing means and said one of said slip means, said releasable means including an abutment member engaged with one of said sleeves and frangible support means for said abutment member engaged by the other of said sleeves, said frangible support means including a support ring engageable by said body, and frangible means supporting said abutment member on said support ring enabling said abutment member to be displaced from said support ring.

44. In a double holding well casing tool assembly: an elongated body; upwardly holding slip means expansible outwardly from said body into anchoring engagement with the casing; downwardly holding slip means expansible outwardly from said body into anchoring engagement with the casing responsive to relative longitudinal movement of said body and said slip means in one direction, including releasable means holding one of said slip means anchored; and means for releasing said releasable means responsive to additional longitudinal movement of said body in the same direction relative to said one of said slip means.

45. In a double holding well casing tool as defined in claim 44; means for relatively shifting said body and said slip means, including means connected to said body and to one of said slip means for applying opposing axial forces thereto.

46. In a double holding well casing tool as defined in claim 44; means engageable between said body and the other of said slip means for preventing said additional longitudinal movement of said body and disengageable to permit such additional movement of said body in response to rotation of said body.

47. In a double holding well casing tool as defined in claim 44, means engageable between said body and the other of said slip means for preventing said additional longitudinal movement of said body and disengageable to permit such additional movement of said body in response to rotation of said body, said means for releasing said releasable means including coengageable portions of said body and said releasable means engageable upon said additional longitudinal movement of said body.

48. In a double holding well casing tool as defined in claim 44; means engageable between said body and the other of said slip means for preventing said additional longitudinal movement of said body and disengageable to permit such additional movement of said body in response to rotation of said body, said means for releasing said releasable means including coengageable portions of said body and said releasable means engageable upon said additional longitudinal movement of said body, said body and said slip means having coengageable means for retracting said slip means upon continued longitudinal movement of said body following release of said releasable means.

49. In a double holding well casing tool as defined in claim 44; a first threaded connection between said body and one of said slip means disengageable by rotation of said body to allow said longitudinal movement of said body and said packer means to enable expansion of slip means, a second threaded connection between said body and the other of said slip means disengageable by additional rotation of said body to allow said additional longitudinal movement of said body, and means preventing disengagement of said second threaded connection, said means for releasing said releasable means including coengageable portions of said body and said releasable means engageable upon said additional longitudinal movement of said body.

50. In a double holding well casing packer assembly; an elongated body having an upper end provided with means connectable to means for shifting said body upwardly; a packer and anchor assembly on said body including upper expansible slip and expander means; lower expansible slip and expander means and packing means between said expander means; said packing means including a support sleeve carried by one of said expander means and having a resiliently deformable packing thereon; telescopic thrust sleeves between said resiliently deformable packing and the other of said expander means; releasable means normally holding said thrust sleeves telescopically extended; additional releasable means connecting said body to said lower slip means, whereby relative longitudinal movement of said body and said slip and expander means causes relative movement of said thrust sleeves in extended condition along said support sleeve and expands said slip means and deforms said packing; and means on said body engageable with said releasable means holding said thrust sleeves extended to release the same and allow contraction of said thrust sleeves upon upward movement of said body following release of said additional releasable means.

51. In a double holding packer as defined in claim 50; means for relatively longitudinal shifting said body and said slip and expander means.

52. In a double holding packer as defined in claim 51, said shifting means comprising casing engaging friction means connected to one of said slip means, and connector means on said body releasably connected to said friction means and connectible with a running in string of pipe.

53. In a double holding packer as defined in claim 51, said shifting means comprising cylinder means connected to said body and releasably connected to one of said slip means; and means for admitting pressure fluid from said body into said cylinder means to act on said piston.

54. In a double holding packer as defined in claim 51; said shifting means comprising pressure setting tool means releasably connected to said body and operable to apply opposite forces to said body and to said one of said slip means.

55. In a double holding packer as defined in claim 50; body locking means holding said body longitudinally shifted but enabling said upward movement of said body.

* * * * *